United States Patent [19]

Cotard

[11] 4,366,975

[45] Jan. 4, 1983

[54] STOP DEVICE FOR SECURING DOORS AND PORTALS

[76] Inventor: Didier A. J. Cotard, Le Bourg, Montpinchon, 50210 Cerisy La Salle, France

[21] Appl. No.: 155,668

[22] Filed: Jun. 2, 1980

[30] Foreign Application Priority Data

Jun. 21, 1979 [FR] France ..... 79 15935

[51] Int. Cl.[3] ..... E05C 13/00

[52] U.S. Cl. ..... 292/340

[58] Field of Search ..... 292/183-189, 292/340, 341.14, DIG. 15

[56] References Cited

U.S. PATENT DOCUMENTS

| | | | |
|---|---|---|---|
| 1,005,906 | 10/1911 | Varner | 292/189 X |
| 1,479,398 | 1/1924 | Ollard | 292/DIG. 15 |
| 4,178,024 | 12/1979 | Wagner | 292/57 |

FOREIGN PATENT DOCUMENTS

| | | | |
|---|---|---|---|
| 832297 | 6/1938 | France | 292/341.14 |
| 399125 | 9/1933 | United Kingdom | 292/189 |

*Primary Examiner*—Richard E. Moore

*Attorney, Agent, or Firm*—Hayes & Reinsmith

[57] ABSTRACT

This stop device fixed to the floor, for securing a door in cooperation with a floor bolt, particularly when the door is in its normal closed position, is characterized in that it comprises, on the one hand, a stop element having a front part provided with a projection forming a stop for the door and a rear part situated substantially at floor level, in which is formed a bore for receiving the free end of the floor bolt when the door is secured against the projection and, on the other hand, a recess formed in the floor, whose entrance is closed partly by the stop element and partly by at least one removable cover situated substantially in the same plane as the stop element.

10 Claims, 6 Drawing Figures

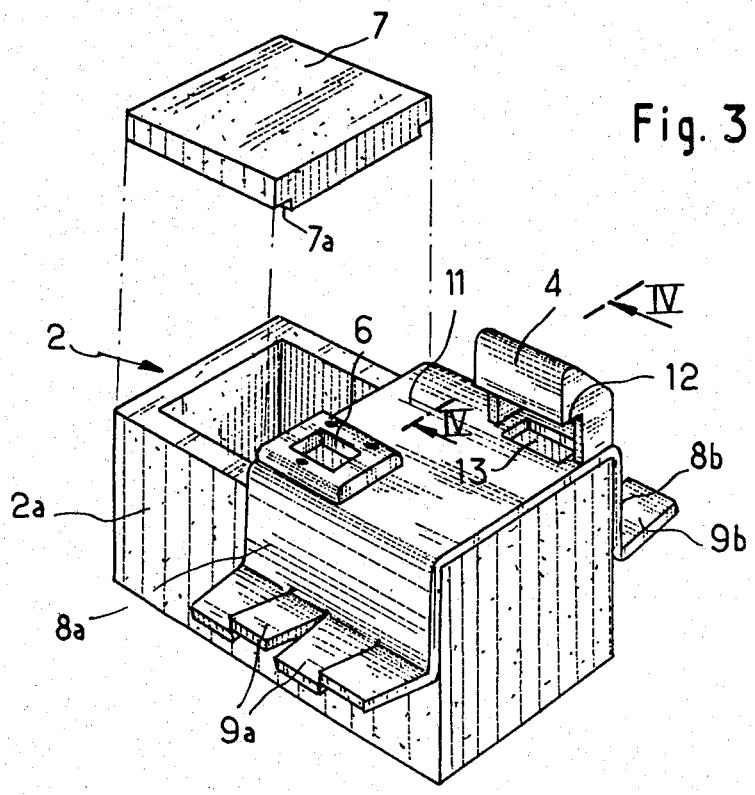
Fig. 3
Fig. 4
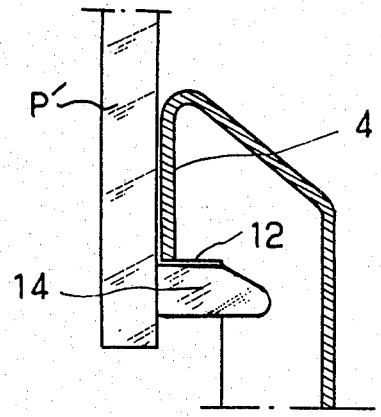

STOP DEVICE FOR SECURING DOORS AND PORTALS

The present invention relates to a stop device fixed to the floor, for securing a door in cooperation with a floor bolt, particularly when the door is in its normal closed position.

At the present time, stop devices for doors or portals are generally formed by a metal plate having a stop against which the door to be secured abuts and a bore for receiving the free end of a floor bolt fixed to one of the doors. The plate is disposed on the floor, which means that the bore has a depth substantially equal to the thickness of the plate. For this reason, it is soon blocked up by earth or other materials brought for example by passers-by or by the door when it moves back. Consequently, the bolt can no longer completely fit into the bore and can then no longer fulfil its function.

The present invention proposes remedying these disadvantages and for this it provides a stop device of the above-mentioned kind, which is characterized in that it comprises, on the one hand, a stop element having a front part with a projection forming a stop for the door and a rear part situated substantially at the level of the floor, in which is provided a bore for receiving the free end of the floor bolt when the door is secured against the projection and, on the other hand, a recess provided in the floor, the entrance to which is closed partially by the stop element and partially by at least one removable cover situated substantially in the same plane as the stop element.

With this arrangement, the materials entering the bore of the stop element fall into the recess. Access may moreover be had at all times to the inside of the recess, through the lid, so as to remove the materials which accumulate therein.

Preferably, the recess provided in the floor is formed by a box sealed in the floor and open at its upper face. Thus, the positioning of the stop device may be rapidly effected since the box may for example be prefabricated.

In one preferred embodiment, the bottom of the box has a hole therethrough which allows the rainwater to drain away which might penetrate into the box.

Advantageously, the lower face of the cover is provided with a rebate cooperating with the inner face of the walls of the box.

As a variation, the walls of the box are provided, at their upper end, with a rebate cooperating with the lower face of the cover.

With these arrangements which may be used alternatively, the cover may be easily and rapidly centred on the box, while still being secured laterally.

In a particular embodiment, the bore for receiving the free end of the floor bolt is situated opposite the projection. This embodiment is essentially used for securing portals with one or two doors bolted manually, in which the floor bolt is carried by the door which comes into abutment against the projection.

In another particular embodiment, the bore for receiving the floor bolt is staggered laterally with respect to the projection. This embodiment is essentially used for securing portals with electric bolting comprising two doors the first of which is stopped by the projection and the second, which carries an electrically controlled bolt, is secured against a rebate of the first one, or a part of the projection.

Advantageously, the projection is hollow and comprises on its stop face a notch communicating with the recess and intended to receive a stud projecting from the door, when this latter is in abutment against the projection.

Thus, the portal, once bolted, will be secured vertically, which prevents it being broken open.

According to another embodiment, the stop element is an inserted piece whose front and rear parts are provided with sides running along the outer faces of two opposite walls of the box and ending in divergent sealing lugs.

According to another variation, the stop element forms an integral part of the box.

Two embodiments of the invention will be described herebelow by way of example, with reference to the accompanying drawings in which:

FIG. 3 is a perspective view of the second embodiment, the cover being raised.

FIG. 4 is a partial sectional view along line IV—IV of FIG. 3, the lower part of the door being shown in abutment against the projection.

Figure 1:
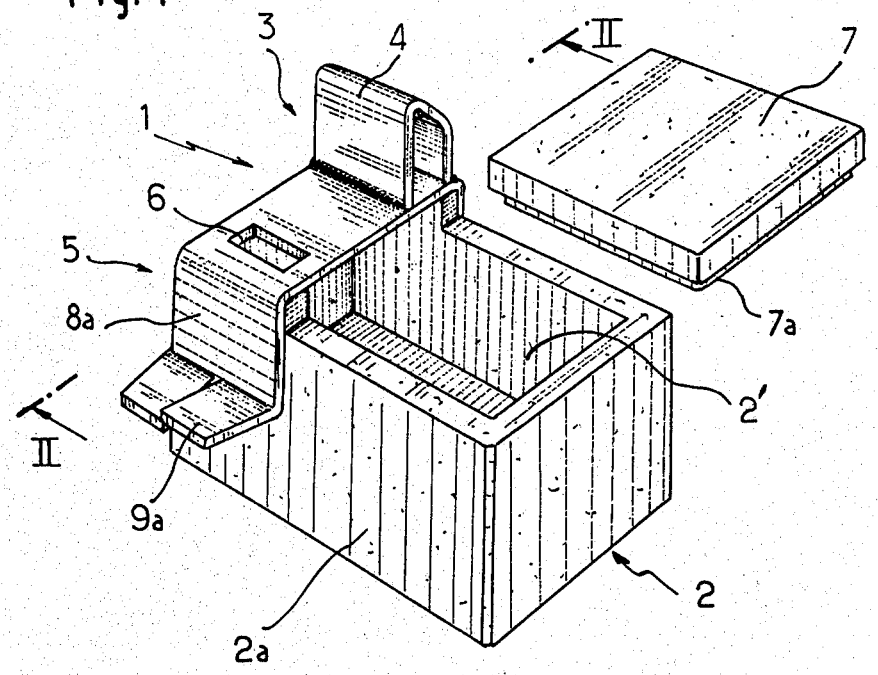
FIG. 1 is a perspective view of the first embodiment, the cover of the box being raised.
Figure 2:
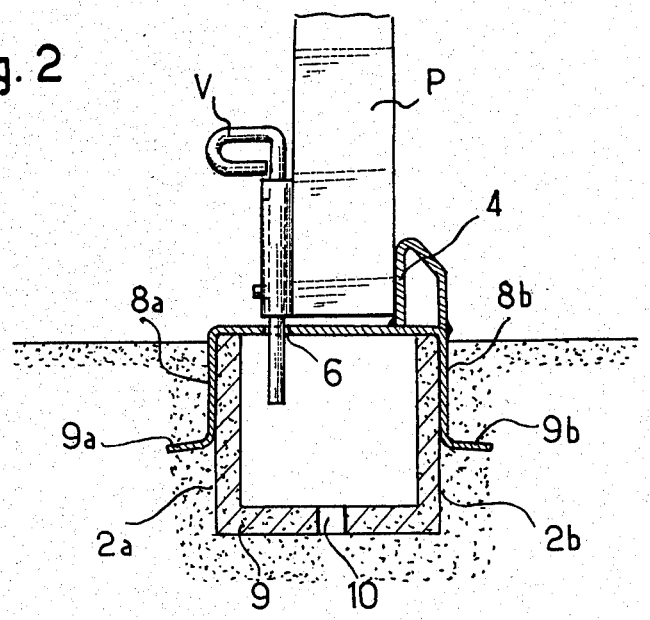
FIG. 2 is a sectional view along line II—II of FIG. 1, in which the stop device is shown fixed to the floor whereas the lower part of the door is in a bolted position on the stop element.

FIGS. 1 and 2 show a first embodiment of the invention which comprises a stop element 1 disposed on a box 2 defining a recess. Stop element 1 comprises a first or front part 3 having a projection 4 forming a stop for a door P and a second or rear part 5 in which is provided a bore 6 for receiving the free end of a floor bolt V provided on door P. Box 2 is open on its upper face defining an entrance 2' which is closed partly by stop element 1 and partly by a removable closure cover 7 situated substantially in the same plane as the stop element when it is positioned on the box. The stop element thus communicates with the inside of the box through bore 6.

The box could of course be closed by two covers, if for example the stop element was situated on the central part of its upper face.

Box 2 appears in FIG. 1 in the form of a parallelepiped. But it is obvious that it could have any other shape, provided that its dimensions are adapted to the size of the stop element. It may be manufactured from any constructional material and is preferably prefabricated.

Generally, the box is formed from vertical or oblique walls and a bottom 9 having a through-hole 10 for draining away rainwater or other water which might accumulate inside.

In the embodiment shown, cover 7 comprises on its lower face a rebate **7*a*** which cooperates with the inner faces of the walls of the box for closing thereof so as to provide rapid centring and lateral securing of the lid.

Figure 5:
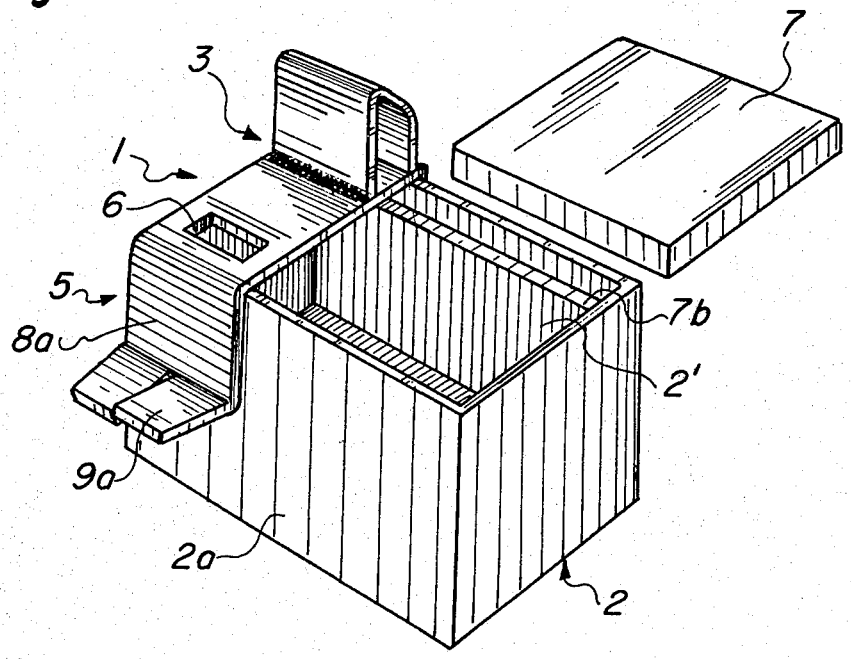
FIG. 5 is a perspective view of a third embodiment, the cover being raised.

According to a variation illustrated in FIG. 5, the walls of the box provided at their upper end with a **7*b* cooperating with the lower face of the cover 7**. Thus the same result as previously would be obtained.

Once the cover is fitted and centred on the box, its upper face comes into the same plane as the stop element, at floor level or slightly above.

In FIG. 1 can be seen one embodiment of the invention in which the stop element is formed by an added piece, provided laterally with two sides 8*a* and 8*b* extending along the outer faces 2*a* and 2*b* of two opposite walls of the box. This added piece has the shape of an inverted U so as to be able to fit onto the parallelepipedic box. But it is obvious that it could have a different shape, corresponding to the outer shape of the particular box used.

Still in this same embodiment, the stop element has sealing lugs 9*a* and 9*b* which extend outwardly of the box, from the free end of each of sides 8*a* and 8*b*, these lugs securing in the floor the stop element positioned on the box.

Figure 6:
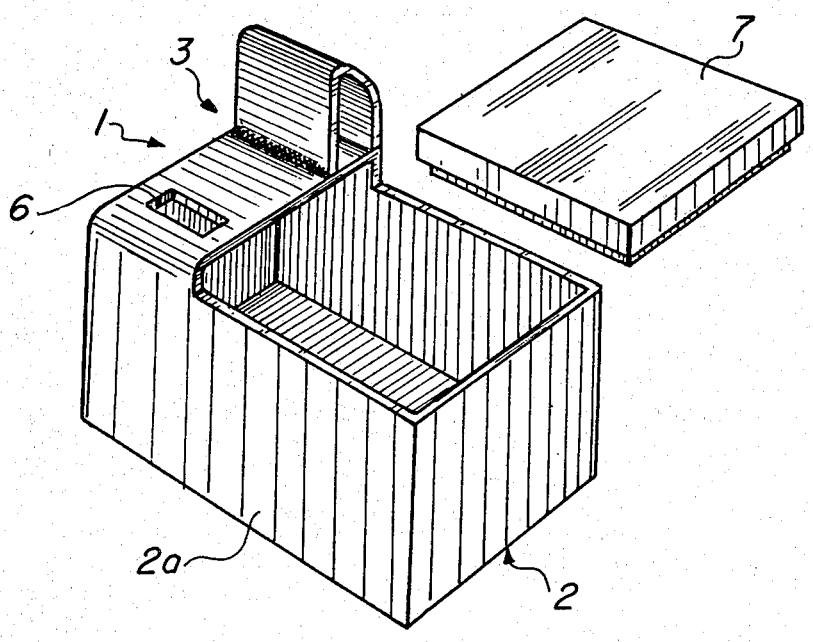
FIG. 6 is a perspective view of a fourth embodiment, the cover being raised.

In a variation shown in FIG. 6, the stop element 1 forms an integral part of the box, either by being moulded therewith, or by being secured thereto by any suitable means.

FIGS. 3 and 4 show another embodiment of the invention in which the stop element has a lateral extension 11 and is provided with sides 8*a* and 8*b*, themselves having sealing lugs 9*a* and 9*b*. In this embodiment, bore 6 for receiving the free end of the floor bolt is formed in the lateral extension 11. This arrangement, in which bore 6 is staggered laterally with respect to projection 4 may be considered when the floor bolt is carried by that one of the two doors which does not come into contact with projection 4, for example when it is controlled electrically. An added plate may advantageously be fixed to the periphery of bore 6 so as to cooperate with the electric bolt when this latter is not sufficiently long.

In FIGS. 3 and 4, it will be further noticed that projection 4 is hollow and comprises on its stop face a notch 12 communicating with the recess through an opening 13. Notch 12 is intended to receive a stud 14 projecting from door P' when this latter is in abutment against projection 4. Thus, it is impossible to raise the door and open it fraudulently. As for opening 13, it allows material carried along the door against the projection to fall into the recess. Naturally, the projection of the device shown in FIG. 1 could be formed in a similar way.

The box of the stop device of the invention is in general made from a material with a cement or other binder base. But it may also be formed from metal, cast metal, plastic material or any other material. As for the stop element, it is generally made from steel or from a cast metal.

The stop device of the invention may be used for securing doors or portals of very different types, both in their closed position and in their open position. For this, it will be sealed in the floor so that the cover of the box is substantially at floor level and so that only the projection projects from the floor. It will be positioned in a plane such that it may cooperate with the floor bolt, in the desired position for securing the corresponding door or portal. For example, for securing in a closed position a portal with two doors, it will be placed at the level of the line where the two doors meet.

As has been seen, the stop device of the invention provides numerous advantages, particularly that of preventing the bore for receiving the floor bolt from being stopped up. For complete efficiency of the stop device of the invention, the recess must of course be periodically emptied, access being had thereto through the cover. The stop device of the invention provides another advantage residing in the vertical securing of the closed doors or portals, which prevents their being broken open while still allowing the portal to be taken down rapidly without unbolting or unpinning when it is placed in an open position.

The stop devices of the invention may be of any sizes and find their application in the securing of portals and doors of all dimensions, having manual or electric bolting.

I claim:

1. A stop device fixed to the floor for securing a door in cooperation with a floor bolt when the door is in its normally closed position and comprising a recess formed in the floor, the recess having an upper opening defining an access entrance, a removable closure for covering in part the entrance of the recess, and a stop element having first and second parts, the first part provided with a projection forming a stop for the door, the second part provided with a bore for receiving the free end of the floor bolt when the door is secured against the projection, the removable closure and the second part of the stop element each being situated, at least in part, substantially at floor level in overlying relation to the entrance of the recess with the bore communicating with the recess.

2. The device of claim 1 wherein the recess is formed by a box sealed in the floor and having an open upper face.

3. The device of claim 2 wherein the bottom of the box has a hole therethrough.

4. The device of claim 2 or 3 wherein the closure has a lower face provided with a rebate cooperating with inner faces of walls of the box.

5. The device of claim 2 or 3 wherein walls of the box are provided, at their upper end, with a rebate cooperating with a lower face of the closure.

6. The device of claim 1 or 2 wherein the bore for receiving the free end of the floor bolt is situated opposite the projection.

7. The device of claim 1 or 2 wherein the second part of the stop element has a longitudinal axis, and wherein the bore for receiving the floor bolt and the projection are offset in opposite lateral directions relative to said longitudinal axis.

8. The device of claim 1 or 2 wherein the projection is hollow and includes a stop face with a notch communicating with the recess and intended to receive a stud projecting from the door when the door abuts the projection.

9. The device of claim 2 wherein the stop element is an added piece the first and second parts of which are provided with sides extending along outer faces of two opposite walls of the box and terminating in divergent sealing lugs.

10. The device of claim 2 wherein the stop element forms an integral part of the box.

* * * * *